United States Patent [19]

Müller

[11] 4,402,496

[45] Sep. 6, 1983

[54] METHOD OF MANIPULATING PRINTED SHEETS

[75] Inventor: Hans Müller, Zofingen, Switzerland

[73] Assignee: Grapha-Holding AG, Hergiswil, Switzerland

[21] Appl. No.: 307,083

[22] Filed: Sep. 29, 1981

[30] Foreign Application Priority Data

Oct. 8, 1980 [CH] Switzerland ..... 7500/80

[51] Int. Cl.[3] ..... B65H 5/30

[52] U.S. Cl. ..... 270/55; 270/57

[58] Field of Search ..... 270/54–58

[56] References Cited

U.S. PATENT DOCUMENTS 3,052,463 9/1962 Snyder ..... 270/57

4,295,643 10/1981 Vega ..... 270/57

*Primary Examiner*—A. J. Heinz

*Attorney, Agent, or Firm*—Kontler, Grimes & Battersby

[57] ABSTRACT

Folded cover sheets are conveyed seriatim from a first magazine into each of several parallel channels during each of a series of successive intervals. Such sheets are opened up on entry into the channels and are transported past one or more locations where they receive inserts which are supplied from one or more additional magazines, again in such a way that each additional magazine admits an insert into each channel during each of the successive intervals. The thus obtained groups of sheets are gathered into larger groups which are assembled into a continuous stream of partly overlapping groups.

8 Claims, 5 Drawing Figures

METHOD OF MANIPULATING PRINTED SHEETS

BACKGROUND OF THE INVENTION

The present invention relates to a method of manipulating sheets, especially printed sheets. More particularly, the invention relates to improvements in a method of assembling different types of sheets into groups, such as newspapers wherein a folded-over outer section confines one or more inner sections or inserts each of which, in turn, can constitute a folded-over section. Still more particularly, the invention relates to improvements in a method of stacking or interleaving two or more differently dimensioned, imprinted and/or colored sheets to form groups of dissimilar sheets, newspapers with one or more sections inserted into an outer section, and/or a combination of these.

U.S. Pat. No. 3,414,257 and Swiss Pat. No. 449,666 disclose a machine for the transport of first sheets along a single elongated path and for addition of one or more second sheets to successive first sheets in such path. Each first sheet is delivered into the receiving or inlet end of a channel which defines the elongated path, and the first sheets are transported along such path to advance past one or more locations of admission of second sheets. If the first sheets are folded over themselves, they can be opened up prior to reaching the location for reception of the foremost or another second sheet so that each second sheet or any selected second sheet can be inserted into the space between the spread-apart panels of the oncoming first sheet. Such procedure can be followed, for example, to assemble the sections of newspapers wherein an outer section confines one or more additional sections or inserts.

A drawback of the just described conventional machines and of the method which can be practiced by resorting to such machines is that the output is relatively low. This is due to the fact that the rate at which the first and second sheets can be transported along the single elongated path during assembly of each first sheet with one or more second sheets is well below the maximum output of feeding units or feeders which deliver sheets into the path. Thus, and in order to allow for proper assembly of first and second sheets, the feeding units which deliver first and second sheets into the aforementioned path must be operated well below capacity. The speed of transport of sheets along the elongated path cannot be increased at will because the sheets would be likely to undergo deformation in response to contact with pushers which advance the sheets along the path as well as owing to resistance of air and the development of air currents as a result of rapid advancement of the sheets. On the other hand, the just discussed method of assembling first and second sheets exhibits many important advantages, especially because it can be practiced by resorting to relatively simple, compact and reliable machines. Moreover, the initial and maintenance costs of the machines are very reasonable, and the extent to which such machines must be attended to or monitored in actual use is negligible.

OBJECTS AND SUMMARY OF THE INVENTION

An object of the invention is to provide a method of assembling different types of sheets into groups in the form of stacks or the like at a rate greatly exceeding the rate of assembling in accordance with heretofore known procedures.

Another object of the invention is to provide a method of the just outlined character which can be practiced by resorting to known machinery.

A further object of the invention is to provide a method of the above outlined character which can be resorted to for insertion of one or more second sheets into folded first sheets or for stacking of different or identical sheets on top of or next to each other.

Still another object of the invention is to provide a novel and improved method of assembling a continuous stream of partially overlapping groups of dissimilar sheets or of assembling accumulations of dissimilar or similar sheets.

An additional object of the invention is to provide a method which renders it possible to utilize, the capacity, each and every one of components or units in the machine for the practice of the method or, at the very least, to operate at maximum speed those components or units which are most likely to contribute to higher output of the machine.

A further object of the invention is to provide a method of rapidly accumulating large numbers of groups of dissimilar sheets per unit of time without the danger of improper stacking or grouping and/or deformation of certain sheets or all sheets as a result of impact by transporting and/or other instrumentalities and/or as a result of the resistance offered by the surrounding atmosphere.

The invention is embodied in a method of manipulating sheets, such as sections of newspapers and/or discrete pages. The method comprises the steps of accumulating and maintaining a first and at least one second source respectively containing first and second sheets (each such source can constitute or include a magazine containing a stack of overlapping or neighboring sheets), establishing a plurality of elongated paths having receiving ends and discharge ends (such paths can be established by elongated channels forming part of discrete transporting units for advancement of sheets at right angles to the direction of delivery or feed of sheets from the respective sources), conveying from the first source to the receiving end of each path a first sheet during each of a series of successive intervals or cycles (i.e., if the number of paths equals three, the conveying step includes delivering from the first source a separate sheet to each of the three paths during each of a series of successive intervals or cycles of the machine which is used for the practice of the method), transporting successive first sheets from the receiving toward the discharge ends of the corresponding paths, admitting from the second source to each of the paths a second sheet during each of the successive intervals, and assembling each such second sheet with a first sheet in the respective path to thus form a group of sheets during transport of first sheets toward the discharge ends of the respective paths.

The method can further comprise the steps of accumulating groups containing first sheets which have entered the paths during successive intervals into first streams of at least partially overlapping groups downstream of the discharge ends of the paths, and uniting such streams of accumulated groups into a continuous stream (e.g., into a so-called scalloped stream) wherein the groups at least partially overlap each other.

The conveying step can comprise introducing first sheets into the receiving ends of the paths in a predetermined sequence during each of the aforementioned intervals, and the accumulating step then comprises arraying the first sheets in each of the groups in a sequence which is identical with the predetermined sequence. The uniting step then includes placing next to each other those groups of sheets which were delivered into the paths during successive intervals.

If each first sheet has two overlapping panels, the method can further comprise the step of opening up such first sheets in the respective paths and the assembling step then includes introducing the second sheets between the panels of the respective (oncoming) first sheets.

The conveying and admitting steps may include advancing the first and second sheets substantially at right angles to the longitudinal directions of the paths.

The first step can include accumulating and maintaining several second sources, and the admitting and assembling steps then respectively comprise (a) advancing, during each of the aforementioned intervals, a second sheet from each of the second sources into each of the paths, and (b) assembling each first sheet with several second sheets, one from each second source. Otherwise stated, the conveying step can include advancing (during each of the aforementioned intervals) n first sheets along a plurality of second paths substantially at right angles to the longitudinal directions of the elongated paths, such second paths having a common section close to the first source and n being the total number of elongated paths.

The assembling step can include stacking the first and second sheets of each group on top of each other, i.e., the first sheets need not have overlapping or folded-over panels and need not be opened up prior to reaching the location for admission of second sheets into the respective paths. As a rule, or at least in many instances, the overall number of sheets in each group will exceed two.

The novel features which are considered as characteristic of the invention are set forth in particular in the appended claims. The improved method itself, however, together with additional features and advantages thereof, will be best understood upon perusal of the following detailed description of certain specific embodiments of a machine which can be utilized for the practice of the method.

DESCRIPTION OF THE PREFERRED EMBODIMENTS

Figure 1:
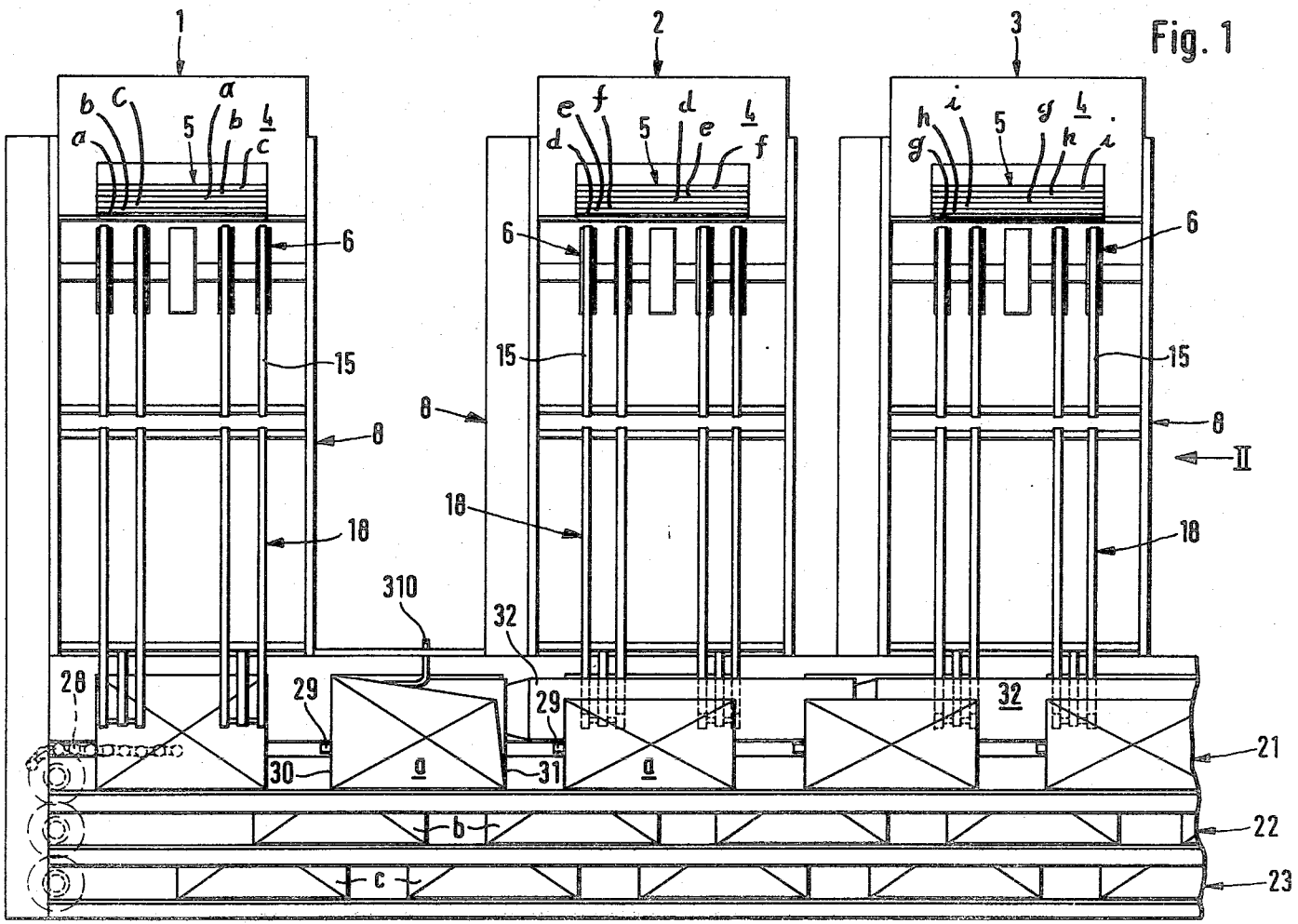
FIG. 1 is a plan view of a machine which can be utilized for the practice of the improved method, the right-hand portion of the machine being broken away.
Figure 2:
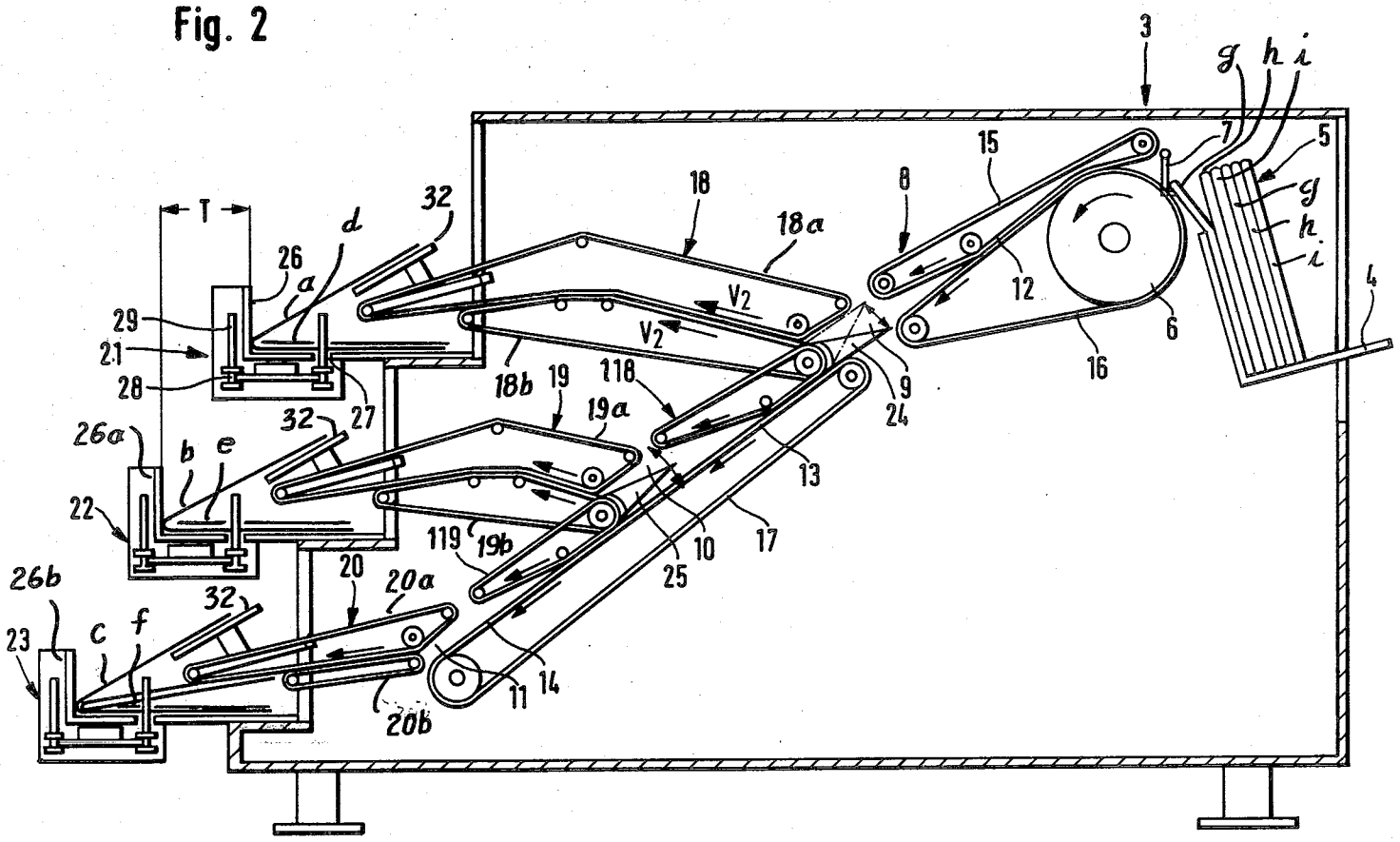
FIG. 2 is a side elevational view of the machine as seen in the direction of arrow II in FIG. 1.

Referring first to FIGS. 1 and 2, there is shown a machine which comprises three parallel sheet feeding units or feeders 1, 2 and 3. The first or leftmost sheet feeding unit 1 of FIG. 1 serves to deliver folded-over sheets in sets or series of three, namely a series of three sheets a, b and c during each cycle of the machine. The second and third sheet feeding units 2 and 3 serve to respectively deliver second sheets or inserts d, e, f and g, h, i into sheets a, b and c which issue from the feeding unit 1.

Each of the sheet feeding units 1, 2 and 3 comprises a magazine 4 for storage of a stack or supply 5 of overlapping sheets (the term sheets is used to denote individual or discrete sheets as well as folded-over sheets or assemblies of two or more sheets each). The magazines 4 are adjacent to substantially drum-shaped withdrawing devices 6 which rotate about horizontal axes and remove sheets seriatim from the respective magazines 4, always in series of three. As shown in FIG. 2 for the sheet feeding unit 3, the corresponding withdrawing device 6 receives successive foremost sheets g, h, i, g, h, i . . . from the adjacent magazine 4 by sets or rows of suction heads or suction cups 7 (only one can be seen in FIG. 2) which deflect the upper portions of successive foremost sheets in a direction to the left, as viewed in FIG. 2, and into the range of suitable grippers on the withdrawing device 6 so that such device can properly engage and completely extract successive foremost sheets from the respective magazine. Reference may be had to commonly owned U.S. Pat. No. 4,085,927; the disclosure of this patent is incorporated herein by reference.

Each withdrawing device 6 delivers the corresponding sheets to a conveyor system including a primary conveyor 8 and three connecting or secondary conveyors 18, 19 and 20. The sheet feeding units 1, 2, 3, further comprise suitable diverting units 9 and 10 which can be activated to divert sheets from the respective primary conveyor 8 onto or into the associated connecting or secondary conveyors 18, 19 and 20. When the diverting units 9 and 10 are inactive, sheets which issue from the respective magazine 4 advance along the path which is defined by the corresponding primary conveyor 8 and are admitted (at 11) into or onto the third connecting or secondary conveyor 20. The diverting units 9 and 10 subdivide the primary conveyor 8 into three sections including a first or foremost section 12 which receives sheets a from the corresponding withdrawing device 6, a second section 13 which can receive sheets b from the first section 12 when a wedge-like switching device 24 of the diverting unit 9 is held in one of its end positions, and a third section 14 which can receive sheets c from the second section 13 when a switching device 25 of the diverting unit 10 is held in one of its two end positions.

The first section 12 of the primary conveyor 8 comprises two endless conveyor belts 15 and 16 which define the first portion of an elongated path, such portion extending from the location where the corresponding withdrawing device 6 delivers successive sheets a, b, c into the space between the two neighboring reaches of the belts 15, 16 and on to the first diverting unit 9. The two neighboring reaches of the belts 15 and 16 travel in the same direction (as indicated by arrows) so as to advance successive sheets toward the diverting unit 9.

The sections 13 and 14 of the primary conveyor 8 have a common conveyor belt 17 and two discrete endless conveyor belts 118 and 119, respectively. The neighboring reaches of the belts 17 and 118 travel in the same direction as the neighboring reaches of the belts 15 and 16, namely, so as to advance sheets b and c from the first diverting unit 9 toward the second diverting unit 10. The neighboring reaches of the conveyor belts 17 and 119 also advance in the same direction, namely, so as to advance sheets c from the diverting unit 10 toward the inlet (at 11) of the secondary conveyor 20. The velocity (V1) of the belts 15, 16, 17, 118, 119 in the primary conveyor 8 is the same.

The secondary conveyor 18 comprises two endless conveyor belts 18*a* and 18*b* having neighboring reaches which travel in directions indicated by the arrows to advance sheets a at a different second speed (V2). The conveyor belts 18*a* and 18*b* receive sheets a from the section 12 of the primary conveyor 8 when the wedge-like switching device 24 of the diverting unit 9 is caused to assume a position corresponding to the solid-line position of the device shown in FIG. 2. The secondary conveyor 19 comprises two endless conveyor belts 19*a* and 19*b* having neighboring reaches which advance sheets b in the direction indicated by arrows and at the velocity (V2) of belts 18*a* and 18*b*. The secondary conveyor 20 has two endless belts 20*a* and 20*b* with neighboring reaches which advance sheets c in the direction indicated by arrows and at the velocity (V2) of the belts 18*a*, 18*b*, 19*a*, 19*b*.

The sheet feeding unit 1 of FIG. 1 can deliver sheets a, b, c into three discrete elongated horizontal paths which are respectively defined by elongated transporting devices 21, 22 and 23. The transporting device 21 has a first channel 26 which can receive sheets a from the secondary conveyor 18; the transporting device 22 has a similar second channel 26*a* which can receive sheets b from the secondary conveyor 19; and the transporting device 23 has a third elongated channel 26*b* which can receive sheets c from the secondary conveyor 20 of the sheet feeding unit 1.

The mechanisms which can pivot the wedge-like switching devices 24 and 25 of the respective diverting units 9 and 10 between two end positions are not specifically shown in the drawing. Reference may be had to the commonly owned U.S. Pat. No. 4,235,434 granted Nov. 25, 1980 for "Apparatus for diverting groups of paper sheets or the like to processing machines". When the switching device 24 of the diverting unit 9 in the unit 1 assumes a position corresponding to the phantom-line position of the device 24 shown in FIG. 2, it causes successive sheets b and c to advance from the section 12 to the section 13 of the primary conveyor 8. When the device 24 of the unit 1 is moved to a position corresponding to the solid-line position of the device 24 shown in FIG. 2, its upper side causes a sheet a to enter between the belts 18*a*, 18*b* of the secondary conveyor 18.

The manner of moving the switching device 25 of the second diverting unit 10 in the unit 1 is analogous. When this device assumes one of its end positions, it causes the sheets b to advance between the belts 19*a*, 19*b* of the secondary conveyor 19. In the other of its end positions, the switching device 25 of the unit 1 causes each sheet c to advance to the section 14 of the primary conveyor 8 and thereupon between the belts 20*a*, 20*b* of the connecting conveyor 20.

As stated above, each of the withdrawing devices 6 removes three sheets during each cycle of the machine embodying the structure shown in FIGS. 1 to 4. The device 6 of the sheet feeding unit 1 removes three sheets a, b and c; the device 6 of the second sheet feeding unit 2 withdraws sheets d, e and f; and the device 6 of the third sheet feeding unit 3 withdraws sheets g, h and i. During the next cycle, the sheet withdrawing devices 6 of the units 1, 2, 3 again respectively withdraw sheets a–c, d–f and g–i. The same procedure is repeated again and again whereby the machine accumulates groups G of sheets each of which includes a sheet a, b or c, a sheet d, e or f as well as a sheet g, h or i. When the withdrawing device 6 of the sheet feeding unit 1 begins to deliver a series of three successive sheets a, b, c, the switching devices 9 and 10 of the unit 1 ensure that the sheet a enters the channel 26, that the sheet b enters the channel 26*a* and that the sheet c enters the channel 26*b*. This means that, during each machine cycle, the receiving end (this is the left end, as viewed in FIG. 1) of each of the three elongated horizontal paths defined by the transporting devices 21, 22, 23 receives a sheet (a, b and c, respectively) from the magazine 4 of the unit 1. The sequence of delivery of sheets by the withdrawing device 6 of each of the sheet feeding units 1, 2 and 3 can be so rapid that the intervals between the deliveries of successive sheets of a series are not or need not be shorter than the intervals between deliveries of successive series of sheets. In other words, the interval between the deliveries of sheets a and b can be just as long as that between the deliveries of sheets b and c, c and a, etc. Furthermore, it is clear that the heretofore described sequence can be altered without departing from the spirit of the invention. For example, the transporting device 23 can receive a sheet (c) of each series ahead of the transporting devices 21 and 22, the transporting device 22 can receive a sheet (b) of a given series ahead of the transporting devices 21 and 23, or the transporting device 21 can receive sheets (a) ahead of the delivery of corresponding sheets (b) and (c) to the transporting devices 22 and 23. At the present time, the units 1, 2 and 3 are preferably operated in such a way that the switching device 24 of the first diverting unit 9 is held first in a position corresponding to the solid-line position of the device 24 shown in FIG. 2 so that the first sheet a enters the secondary conveyor 18, that the switching device 24 is thereupon immediately pivoted to a position corresponding to the phantom-line position of the device 24 shown in FIG. 2 while the switching device 25 remains in the lower end position in which it diverts the oncoming sheet b into the conveyor 19, that the switching device 25 is thereupon pivoted to its upper end position so that it allows the oncoming sheet c to advance toward the conveyor 20, and that the switching devices 24, 25 are thereupon moved back immediately (either simultaneously or one after the other) to reassume their original positions so that the next sheets a, b and c are again delivered to the connecting conveyors 18, 19 and 20, respectively.

The operation of the sheet feeding unit 2 is the same as that of the unit 1 except that the unit 2 delivers successive series of sheets d, e, f into median portions of the channels 26, 26*a* and 26*b*. The sheet feeding unit 3 delivers successive series of sheets g, h, i into the downstream portions of the respective channels 26, 26*a*, 26*b*.

The length of each of sections 13, 14 of the primary conveyor 8, the lengths of secondary conveyors 18, 19, 20 and the velocities of these conveyors are selected in such a way that, when the machine is operated at a constant speed, the intervals of time which are required to transfer sheets from the diverting unit 9 to the transporting units 21, 22 and 23 are the same. In other words, after completion of each third of a cycle (namely, on each revolution of each of the drum-shaped withdrawing devices 6), the three conveyors 18 or the three conveyors 19 or the three conveyors 20 deposit one sheet each in the respective channels 26, 26*a* and 26*b*.

As mentioned above, the transporting devices 21, 22 and 23 respectively comprise elongated channels 26, 26*a* and 26*b* which extend at right angles to the directions of transport of sheets from the magazines 4 to such channels. Each of the channels 26–26*b* has an elongated bottom wall with a continuous slot 27 for equidistant entraining elements or pushers 29 provided on endless chains 28 which are installed at levels below the respective channels. FIG. 2 merely shows the upper reaches of the three chains 28. The spacing between two neighboring pushers 29 on a given chain 28 corresponds to the distance which a chain 28 covers from the start to the end of a machine cycle (transfer of three successive sheets from the magazine 4 of the unit 1, 2 or 3). The pushers 29 of the three chains 28 enter the respective slots 27 in a region which is located to the left of the leftmost sheet feeding unit 1 of FIG. 1 so that they entrain the freshly delivered sheets a, b and c coming from the magazine 4 of the unit 1 and having been supplied by the secondary conveyors 18, 19 and 20, respectively. Each pusher 29 engages the trailing edge 30 of the respective sheet a, b or c. At such time, the leaders 31 of these sheets are spaced apart from the preceding pushers 29 (note the lower part of FIG. 1). The sheets a, b and c are staggered with reference to each other, as considered in the longitudinal direction of the channels 26, 26*a* and 26*b*, i.e., the sheet a which is delivered during a given cycle is located (in the channel 26) slightly ahead of the sheet b (in the channel 26*a*) which is delivered during the same cycle, and the sheet c (in the channel 26*b*) which is delivered during the same cycle is located slightly behind the sheet b. The extent to which the three sheets a to c of a series of three first sheets are staggered is the same. The channels 26, 26*a* and 26*b* are disposed at different levels (such levels are equidistant from each other), and the neighboring channels 26, 26*a* and 26*a*, 26*b* are staggered (by distances T) with reference to each other, as considered at right angles to their longitudinal directions. FIG. 2 shows that the uppermost channel 26 slightly overlaps the median channel 26*a*, and the latter slightly overlaps the lowermost channel 26*b*.

The space between the sheet feeding units 1 and 2 accommodates three discrete spreading elements 310 (only one shown in FIG. 1) which serve to open up the folded sheets a, b and c in the respective channels 26, 26*a* and 26*b* before the thus opened sheets reach the discharge end of the second sheet feeding unit 2. This ensures that the second sheets or inserts d, e and f are respectively introduced into the spaces between the panels of the oncoming sheets a, b and c, and also that the second sheets or inserts g, h and i are respectively placed on top of the oncoming sheets d, e and f within the confines of panels of the respective sheets a, b and c. The means for maintaining the spread-open panels of the sheets a in the channel 26 in open positions during travel past the discharge ends of the sheet feeding units 2 and 3 comprises elongated guide rails 32 of sheet metal or the like. Similar guide rails are provided adjacent to the channels 26*a* and 26*b* to respectively prevent premature closing of the sheets b and c. The spreading elements 310 may comprise knife-like blades whose edges penetrate between the panels of the oncoming sheets a, b and c. Reference may also be had to Swiss Pat. No. 449,666 which discloses suitable spreading elements in the form of rotary suction cups.

When a first sheet a, b or c advances beyond the right-hand or rightmost guide rail 32, as viewed in FIG. 1, the panels of such sheet can move nearer to each other so that the inserts (d, e or f and g, h or i) are confined between the folded-together panels and the resulting groups G of sheets can leave the respective transporting devices 21, 22 and 23. The groups G may constitute daily or weekly newspaper with an outer section (a, b or c) which confines one or more inserts, depending on the total number of sheet feeding units and the number of active units for the feeding of inserts. For example, the sheet feeding unit 2 or 3 of FIG. 1 can be deactivated if each of the groups G is to contain a single insert.

Figure 3:
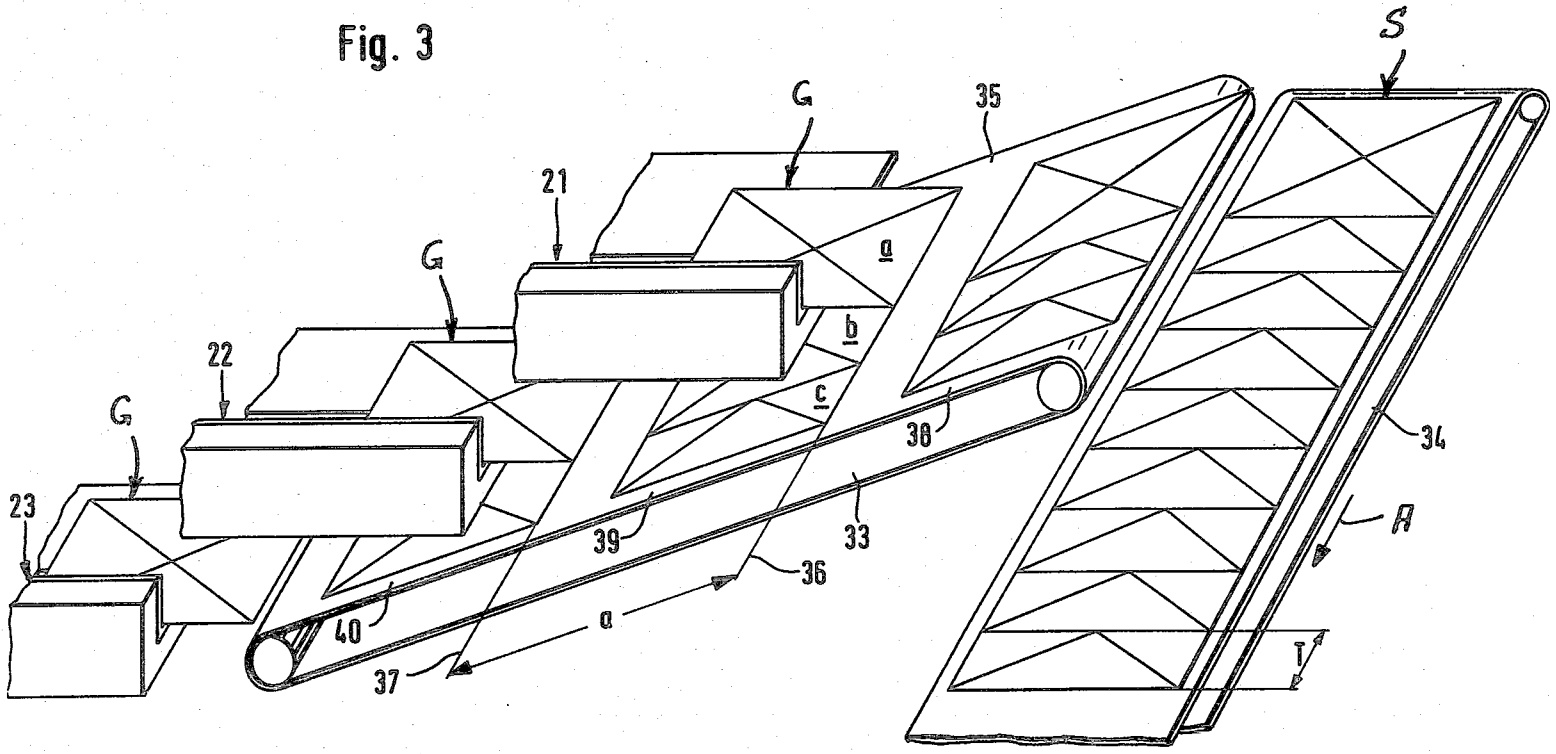
FIG. 3 is a fragmentary schematic perspective view of that (right-hand) portion of the machine which is broken away in the plan view of FIG. 1.

The discharge ends of the transfer units 21, 22 and 23 terminate at a level above the upwardly sloping upper reach 35 of an assembling conveyor 33 which can transport the arriving groups G in the same direction as the chains 28, i.e., in a direction to the right, as viewed in FIG. 3. The discharge end of the assembling conveyor 33 is adjacent to the upper reach of a preferably endless removing conveyor 34 which travels in a direction at right angles to the direction of travel of the upper reach 35 of the conveyor 33 and whose function is to assemble shorter streams each of which contains three groups G of sheets into a continuous stream S of partly overlapping groups (the so-called scalloped stream) which is ready to be delivered to a baling or like machine in a manner not forming part of the present invention. Reference may be had to commonly owned U.S. Pat. No. 4,090,441 granted May 23, 1978 for "Apparatus for stacking and baling newspapers or the like".

The reference characters 36 and 37 denote in FIG. 3 two imaginary lines which extend at right angles to the direction of travel of the flat upper reach 35 of the assembling conveyor 33 and divide the upper reach into three successive sections 38, 39 and 40. The discharge end of the channel 26*b* delivers a group G including a sheet c to the imaginary line 37 simultaneously with delivery of a group G including a sheet b (such group is delivered via channel 26*a* of the median transporting unit 22), and the thus aligned groups G including the sheets b and c reach the imaginary line 36 simultaneously with the leader 32 of the corresponding sheet a, i.e., simultaneously with the leading edge of the group G which includes the sheet a and was caused to advance along the bottom wall of the uppermost channel 26. It will be noted that the leaders of three groups G including the sheets a, b and c which were supplied to the channels 26–26*b* during any given cycle or during successive cycles are aligned with each other, as considered at right angles to the direction of travel of the upper reach 35, when they are about to leave the assembling conveyor 33 in order to descend onto the upper reach of the removing conveyor 34. This ensures the formation of a uniform scalloped stream S wherein the neighboring (partly overlapping groups G) are staggered with reference to each other by distances T corresponding to the extent to which the channels 26, 26*a* and 26*b* are staggered relative to each other, as considered at right angles to the longitudinal directions of the transporting units 21, 22 and 23.

The removing conveyor 34 is driven, in stepwise fashion, in the direction indicated by the arrow A, always through a distance 3T, so that it accumulates three groups G during each cycle of the machine. This ensures the formation of a uniform scalloped stream S, as considered in the direction of arrow A. Uniformity of the stream S, as considered at right angles to the direction of travel of the stream S, is ensured by the aforediscussed transfer of groups G onto the upper reach 35 of the assembling conveyor 33, namely, in such a way that the groups G including the sheets b and c reach the imaginary line 37 when the leaders of their sheets b and c are aligned with each other, and that the groups G including the sheets b, c on the one hand and the group G including the sheet a reach the imaginary line 36 at a time such that the leaders of their sheets a, b, c are aligned with each other.

If the spreading elements 310 and the guide rails 32 are removed or deactivated, the machine of FIGS. 1 to 3 can be used as a gathering machine wherein the sheets a, b and c are respectively overlapped by the sheets d, e and f, and the sheets d, e and f are respectively overlapped by the sheets g, h and i. In other words, the sheets a, b and c are not opened up but merely constitute the lowermost sheets of successive groups of three sheets. Such a machine can be used for the assembly of inserts which are thereupon delivered to the magazines 4 of the sheet feeding units 2 and 3 in a machine operating in the aforedescribed manner, i.e., to open up the sheets a, b and c in order to allow for admission of inserts into the spaces between the panels of the opened-up sheets a, b and c.

Figure 4:
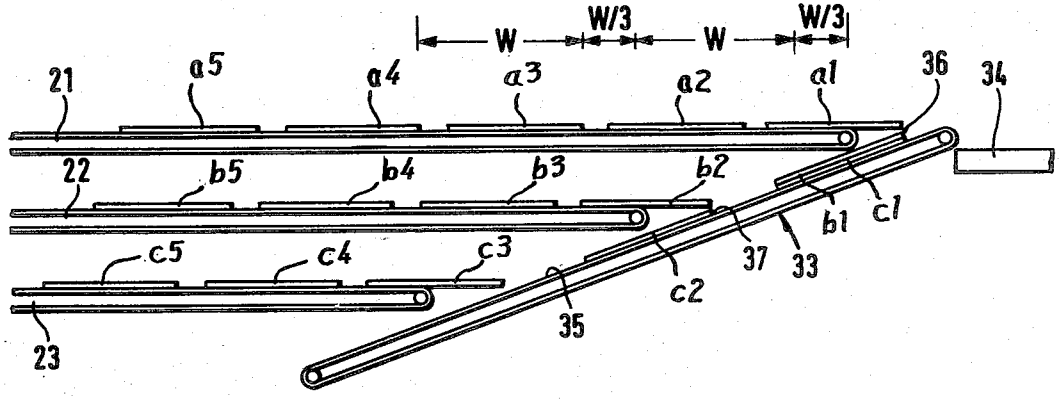
FIG. 4 is a schematic front elevational view of the structure which is shown in FIG. 3.

The mode of assembling groups G into smaller streams of three groups each and thereupon into a continuous stream will be readily understood with reference to FIG. 4 which shows the structure of FIG. 3 in an end elevational view. The sheet a1 which was first to be delivered (into the channel 26) during a given machine cycle travels along the path which is defined by the device 21 and is opened up prior to receiving a sheet d and thereupon a sheet g. The resulting group G leaves the channel 26 in such a way that the leader 31 of the sheet a1 first contacts the imaginary line 36 while descending onto the upper reach 35 of the conveyor 33. The sheet b1 which was removed from the magazine 4 of the unit 1 immediately following removal of the sheet a1 (i.e., during the same cycle) is advanced in the channel 26*a* of the device 22, and the sheet c1 which was also removed from the magazine 4 of the unit 1 during the cycle of removal of sheets a1 and b1 is transported in the channel 26*b* of the device 23. The sheets a1, b1 and c1 respectively receive first and second inserts or sheets (d and g, e and h, f and i) during travel past the discharge ends of the units 2 and 3 of FIG. 1 so that the resulting groups G advance beyond the unit 3 and are ready for transfer onto the upper reach 35 of the conveyor 33. The discharge end of the channel 26 extends beyond the discharge end of the channel 26*a*, and the discharge end of the channel 26*a* extends beyond the discharge end of the channel 26*b*, as considered in the longitudinal direction of the transporting devices 21, 22 and 23. The spacing between the ends of the devices 21 and 22 equals W, the same as that between the ends of the devices 22 and 23. The spacing W equals the distance covered by a sheet in the device 21, 22 or 23 during a machine cycle plus one third of such covered distance. The just described distribution of discharge ends of the transporting devices 21, 22 and 23 ensures that the group G including the sheet c1 reaches the conveyor 33 ahead of the group including the sheet b1, and the group including the sheet b1 reaches the upper reach 35 ahead of the group including the sheet a1. The upper reach 35 transports the group G including the sheet c1 toward the imaginary line 37 which the leader 31 of the sheet c1 reaches simultaneously with initial contact between the leader of the sheet b1 and the upper reach 35. The two aligned groups G including the sheets c1 and b1 then advance toward the imaginary line 36 which their leaders 31 reach simultaneously with the leader 31 of the sheet a1 in the group which is being delivered by the transporting device 21. The groups G including the sheets c1 and b1 partially overlap each other (as considered in the direction of arrow A) starting at the imaginary line 37, and the groups G including the sheets c1, b1, a1 partially overlap each other (again as viewed in the direction of arrow A) starting at the imaginary line 36. The stream including these three groups then advances toward and is deposited on the conveyor 34 which is set in motion to advance by a step whose length equals 3T while the conveyor 33 assembles a fresh stream of three groups G including the sheets a2, b2, c2, thereupon a stream of three groups a3, b3, c3, etc. The lateral spacing or staggering T of channels 26, 26*a*, 26*b* causes the groups G of each stream of three groups each to partially overlap each other, as considered in the direction of arrow A.

Figure 5:
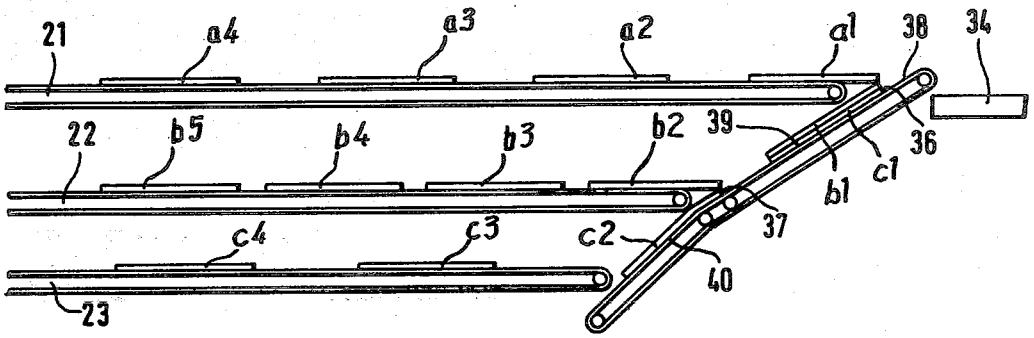
FIG. 5 is a similar schematic front elevational view of a portion of a second machine which can be utilized for the practice of a slightly modified method.

As shown in FIG. 5, it is not necessary that the distance between the levels of the transporting devices 21, 22 be the same as that between the transporting devices 22 and 23. It is equally unnecessary that the distance covered by a sheet or group of sheets in the channel 26 during a machine cycle be the same as the distance covered by a sheet or group of sheets in the channel 26*a* and/or 26*b*. All that counts is to ensure that such distances be equal for all of the sheets in a given channel 26, 26*a* or 26*b*. If the speeds of sheets in the transporting devices 21, 22 and 23 are different, the operation of such units will nevertheless be synchronized by appropriate selection of the lengths of sections 38, 39 and 40 on the assembling conveyor 33 so that the leaders of sheets c1, b1 will simultaneously reach the imaginary line 37, and the leaders of sheets c1, b1 and a1 will reach the imaginary line 36 at the same time.

It is further not critical or even important that the upper reach 35 of the assembling conveyor 33 slope upwardly. It is equally possible to resort to an assembling conveyor whose upper reach slopes downwardly toward the removing conveyor 34; in such a machine the sections 38, 39 and 40 of the assembling conveyor can constitute discrete components, e.g., each thereof can comprise its own endless belt(s), band(s) and/or chain(s).

As mentioned above, the number of sheet feeding units can be reduced to two or increased to four or more, depending on the number of sheets which are to be assembled into a group. If the number of sheets in a group is to be reached to two, one of the units 2, 3 shown in FIG. 1 can be omitted. If only two groups G are to be formed, the primary conveyors 8 are modified so as to comprise only two sections. Also, the number of secondary conveyors is reduced to two. If the number of sheets in a group is increased to four or more, the machine will comprise four or more sheet feeding units. If four or more groups G are to be formed, the number of diverting devices and sections in the primary conveyor as well as the number of secondary conveyors is increased accordingly. Still further, when the number of groups G is changed, the drive for each of the withdrawing drums 6 is then modified so that each drum delivers only two or more than three sheets per cycle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of manipulating sheets such as sections of newspapers or discrete pages comprising the steps of accumulating and maintaining a first source and at least one second source respectively containing first and second sheets, each of said first sheets having two overlapping panels; establishing a plurality of elongated paths having receiving ends and discharge ends; conveying a first sheet from the first source to the receiving end of each path during each of a series of successive intervals; transporting successive first sheets from the receiving ends toward the discharge ends of said paths; opening up the first sheets in the respective paths; admitting from the second source to each of said paths a second sheet during each of said successive intervals; and assembling each such second sheet with a first sheet in the respective path into a group of sheets during transport of the first sheets toward the respective discharge ends, said assembling step including introducing the second sheets between the panels of the respective first sheets.

2. The method of claim 1, wherein said conveying step comprises introducing first sheets into the receiving ends of said paths in a predetermined sequence during each of said intervals, said accumulating step including arraying the first sheets in each of said groups in a sequence which is identical with said predetermined sequence.

3. The method of claim 1, further comprising the steps of accumulating groups containing first sheets which have entered said paths during successive intervals into first streams of at least partially overlapping groups downstream of the discharge ends of said paths, and uniting such accumulated groups into a continuous stream of at least partly overlapping groups.

4. The method of claim 3, wherein said uniting step includes placing the groups of sheets which were delivered into said paths during successive intervals next to each other.

5. The method of claim 1, wherein said conveying and admitting steps include advancing the first and second sheets substantially at right angles to the longitudinal directions of said paths.

6. The method of claim 1, wherein said accumulating and maintaining step includes accumulating and maintaining several second sources and said admitting and assembling steps respectively comprise advancing from each of said second sources into each of said paths a second sheet during each of said intervals and assembling each first sheet with several second sheets, one from each second source.

7. The method of claim 1, wherein said conveying step includes advancing during each of said intervals n first sheets along a plurality of second paths substantially at right angles to the longitudinal directions of said elongated paths, all of said second paths having a common section close to the first source and n being the number of said elongated paths.

8. The method of claim 1, wherein the total number of sheets in each group exceeds two.

* * * * *